US009307321B1

(12) United States Patent
Unruh

(10) Patent No.: US 9,307,321 B1
(45) Date of Patent: Apr. 5, 2016

(54) SPEAKER DISTORTION REDUCTION

(75) Inventor: Andy Unruh, San Jose, CA (US)

(73) Assignee: Audience, Inc., Mountain View, CA (US)

( * ) Notice: Subject to any disclaimer, the term of this patent is extended or adjusted under 35 U.S.C. 154(b) by 313 days.

(21) Appl. No.: 13/492,737

(22) Filed: Jun. 8, 2012

Related U.S. Application Data

(60) Provisional application No. 61/495,336, filed on Jun. 9, 2011.

(51) Int. Cl.
*H04R 29/00* (2006.01)
*H04R 3/04* (2006.01)
*H04R 3/00* (2006.01)

(52) U.S. Cl.
CPC . *H04R 3/04* (2013.01); *H04R 3/007* (2013.01)

(58) Field of Classification Search
CPC ..... H04R 3/007; H04R 3/04; H04R 3/12; H04R 29/00; H04R 29/001
USPC ..... 381/58–59, 87–89, 332, 94.1–94.3, 97, 381/55, 96
See application file for complete search history.

(56) References Cited

U.S. PATENT DOCUMENTS 3,662,108 A 5/1972 Flanagan et al.
4,066,842 A 1/1978 Allen
4,341,964 A 7/1982 Chi et al.
4,426,729 A 1/1984 Gritton
4,888,811 A * 12/1989 Takashi ..... 381/111
5,129,005 A * 7/1992 Zwicky et al. ..... 381/96
5,548,650 A * 8/1996 Clark ..... 381/55
5,587,998 A 12/1996 Velardo, Jr. et al.
5,825,320 A 10/1998 Miyamori et al.
6,269,161 B1 7/2001 McLaughlin et al.
6,289,309 B1 9/2001 deVries
6,507,653 B1 1/2003 Romesburg
6,622,030 B1 9/2003 Romesburg et al.
6,718,041 B2 4/2004 Debail
(Continued)

FOREIGN PATENT DOCUMENTS

WO WO2009117084 9/2009

OTHER PUBLICATIONS

Kleinschmidt, M. "Robust Speech Recognition Based on Spectrotemporal Processing", Oldenburg, Univ., Diss, 2002.
(Continued)

*Primary Examiner* — Xu Mei
(74) *Attorney, Agent, or Firm* — Carr & Ferrell LLP

(57) ABSTRACT

Methods and systems specifically designed to reduce loudspeaker distortion by reducing voice coil excursion are provided. An input audio signal is processed based on a specific linear model of a loudspeaker, and a dynamic filter is generated and applied to this audio signal. The filter changes the relative phases of the spectral components of the input signal to reduce estimated excursion peaks. The quality of the audio signal is not diminished in comparison to traditional filter approaches. The processing of the input signal may involve determining a main frequency which may be used to determine the fundamental frequency. Multiples of the fundamental frequencies provide harmonic frequencies. The phases of all the harmonic frequencies, including the fundamental, may be measured and compared to a target vector of phases. The difference between the measured phases and the target phases may then be used to calculate the poles and zeros and corresponding filter coefficients.

23 Claims, 4 Drawing Sheets

(56) References Cited

U.S. PATENT DOCUMENTS

| | | | | |
|---|---|---|---|---|
| 6,724,899 | B1 | 4/2004 | Taeger et al. | |
| 6,725,027 | B1 | 4/2004 | Tsuji et al. | |
| 6,760,435 | B1 | 7/2004 | Etter et al. | |
| 6,859,531 | B1 | 2/2005 | Deisher | |
| 6,968,064 | B1 | 11/2005 | Ning | |
| 6,999,582 | B1 | 2/2006 | Popovic et al. | |
| 7,039,181 | B2 | 5/2006 | Marchok et al. | |
| 7,062,040 | B2 | 6/2006 | Faller | |
| 7,164,620 | B2 | 1/2007 | Hoshuyama | |
| 7,212,628 | B2 | 5/2007 | Popovic et al. | |
| 7,317,800 | B1 | 1/2008 | Vierthaler et al. | |
| 7,508,948 | B2 | 3/2009 | Klein et al. | |
| 7,643,630 | B2 | 1/2010 | McCree et al. | |
| 7,742,592 | B2 | 6/2010 | Faller | |
| 8,023,641 | B2 | 9/2011 | Rahbar | |
| 8,189,766 | B1 | 5/2012 | Klein | |
| 8,259,926 | B1 | 9/2012 | Avendano et al. | |
| 8,275,120 | B2 | 9/2012 | Stokes, III et al. | |
| 8,295,476 | B2 | 10/2012 | Liu | |
| 8,335,319 | B2 | 12/2012 | Rahbar | |
| 8,355,511 | B2 | 1/2013 | Klein | |
| 8,472,616 | B1 | 6/2013 | Jiang | |
| 9,191,519 | B2 | 11/2015 | Kawabata | |
| 2001/0031053 | A1 | 10/2001 | Feng et al. | |
| 2002/0184013 | A1 | 12/2002 | Walker | |
| 2002/0193130 | A1 | 12/2002 | Yang et al. | |
| 2004/0018860 | A1 | 1/2004 | Hoshuyama | |
| 2004/0042625 | A1* | 3/2004 | Brown | 381/103 |
| 2004/0057574 | A1 | 3/2004 | Faller | |
| 2004/0247111 | A1 | 12/2004 | Popovic et al. | |
| 2006/0018458 | A1 | 1/2006 | McCree et al. | |
| 2006/0072766 | A1 | 4/2006 | Klein et al. | |
| 2006/0098810 | A1 | 5/2006 | Kim | |
| 2007/0041575 | A1 | 2/2007 | Alves et al. | |
| 2007/0058799 | A1 | 3/2007 | Sudo | |
| 2008/0247536 | A1 | 10/2008 | Rahbar | |
| 2008/0247559 | A1 | 10/2008 | Wang | |
| 2008/0260166 | A1* | 10/2008 | Hess | 381/26 |
| 2008/0281584 | A1 | 11/2008 | Hetherington et al. | |
| 2008/0292109 | A1 | 11/2008 | Trump et al. | |
| 2009/0080666 | A1 | 3/2009 | Uhle et al. | |
| 2009/0238373 | A1 | 9/2009 | Klein | |
| 2010/0042406 | A1 | 2/2010 | Johnston et al. | |
| 2011/0019832 | A1 | 1/2011 | Itou et al. | |
| 2011/0178798 | A1 | 7/2011 | Flaks et al. | |
| 2011/0300897 | A1 | 12/2011 | Schell | |
| 2012/0045069 | A1 | 2/2012 | Sun | |
| 2012/0121098 | A1* | 5/2012 | Gautama | 381/59 |
| 2013/0077795 | A1* | 3/2013 | Risbo et al. | 381/55 |

OTHER PUBLICATIONS von Ossirtzky, Carl , "Robust Speech Recognition based on Spetro-Temporal Features", Oldenburg, Univ., Apr. 2004.

International Search Report and Written Opinion dated May 11, 2009 in Patent Cooperation Treaty Application No. PCT/US2009/001667.

Non-Final Office Action, Jun. 12, 2008, U.S. Appl. No. 10/959,408, filed Oct. 5, 2004.

Notice of Allowance, Dec. 10, 2008, U.S. Appl. No. 10/959,408, filed Oct. 5, 2004.

Non-Final Office Action, Jul. 7, 2011, U.S. Appl. No. 12/435,322, filed May 4, 2009.

Non-Final Office Action, Sep. 8, 2011, U.S. Appl. No. 12/004,899, filed Dec. 21, 2007.

Non-Final Office Action, Sep. 8, 2011, U.S. Appl. No. 12/004,896, filed Dec. 21, 2007.

Non-Final Office Action, Oct. 17, 2011, U.S. Appl. No. 12/077,436, filed Mar. 18, 2008.

Final Office Action, Mar. 16, 2012, U.S. Appl. No. 12/077,436, filed Mar. 18, 2008.

Notice of Allowance, Mar. 20, 2012, U.S. Appl. No. 12/004,896, filed Dec. 21, 2007.

Final Office Action, May 3, 2012, U.S. Appl. No. 12/004,899, filed Dec. 21, 2007.

Final Office Action, Jun. 20, 2012, U.S. Appl. No. 12/435,322, filed May 4, 2009.

Notice of Allowance, Jul. 10, 2012, U.S. Appl. No. 12/004,899, filed Dec. 21, 2007.

Advisory Action, Sep. 5, 2012, U.S. Appl. No. 12/435,322, filed May 4, 2009.

Non-Final Office Action, Sep. 13, 2012, U.S. Appl. No. 12/860,428, filed Aug. 10, 2010.

Notice of Allowance, Oct. 9, 2012, U.S. Appl. No. 12/077,436, filed Mar. 18, 2008.

Non-Final Office Action, Dec. 19, 2012, U.S. Appl. No. 12/837,334, filed Jul. 15, 2010.

Notice of Allowance, Feb. 14, 2013, U.S. Appl. No. 12/435,322, filed May 4, 2009.

Non-Final Office Action, Apr. 11, 2013, U.S. Appl. No. 12/860,428, filed Aug. 20, 2010.

Non-Final Office Action, Apr. 24, 2013, U.S. Appl. No. 12/897,692, filed Oct. 4, 2010.

Final Office Action, Jul. 9, 2013, U.S. Appl. No. 12/837,334, filed Jul. 15, 2010.

Final Office Action, Oct. 28, 2013, U.S. Appl. No. 12/860,428, filed Aug. 20, 2010.

Final Office Action, Nov. 6, 2013, U.S. Appl. No. 12/897,692, filed Oct. 4, 2010.

Non-Final Office Action, Aug. 28, 2014, U.S. Appl. No. 12/837,334, Jul. 15, 2010.

Final Office Action, Jun. 17, 2015, U.S. Appl. No. 12/837,334, filed Jul. 15, 2010.

Non-Final Office Action, Jun. 17, 2015, U.S. Appl. No. 12/860,428, filed Aug. 20, 2010.

* cited by examiner

SPEAKER DISTORTION REDUCTION

CROSS-REFERENCE TO RELATED APPLICATIONS

This application claims the benefit of U.S. Provisional Application No. 61/495,336, filed on Jun. 9, 2011, which is incorporated here by reference in its entirety for all purposes.

BACKGROUND

A loudspeaker, or simply a speaker, is an electroacoustic transducer that produces sound in response to an electrical audio input signal. The loudspeaker may include a cone supporting a voice coil electromagnet acting on a permanent magnet. Motion of the voice coil electromagnet relative to the permanent magnet causes the cone to move, thereby generating sound waves. Where accurate reproduction of sound is needed, multiple loudspeakers may be used, each reproducing a part of the audible frequency range. Loudspeakers are found in devices, such as radio and Television (TV) receivers, telephones, headphones, and many forms of audio devices.

SUMMARY

Provided are methods and systems specifically designed to reduce loudspeaker distortion by reducing voice coil excursion. An input audio signal is processed based on a specific linear model of a loudspeaker, and a dynamic filter is generated and applied to this audio signal. The filter changes the relative phases of the spectral components of the input signal to reduce estimated excursion peaks. In various embodiments, the filter does not apply any compression. The filter also does not make any changes of the spectrum of the input signal in some embodiments. The quality of the audio signal is not diminished by the filter in comparison to traditional filter approaches. The processing of the input signal may involve determining a main frequency using a pitch and salience estimator module. The main frequency is then used to generate poles and zeroes and corresponding filter coefficients. In some embodiments, the filter coefficients are complex multipliers and processing is performed by a cochlea module.

In some embodiments, a method for processing an audio signal to reduce loudspeaker distortion involves receiving an input signal and analyzing the input signal based on the linear model of a loudspeaker. This in turn dynamically produces a filter for applying to the input signal. The filter may be configured to reduce voice coil excursion of the loudspeaker without using compression or any changes in a spectrum of the input signal. The method also may involve applying the filter to the input signal to produce a filtered signal provided to the loudspeaker.

In some embodiments, analyzing the input signal involves processing the input signal using a cochlea module. The cochlea module may include a series of band-pass filters. Analyzing the input signal may also involve estimating pitch and salience of the input signal and, in some embodiments, determining a main frequency of the input signal and tracking phases of harmonic frequencies relative to the main frequency. The method may also involve determining poles and zeroes of the harmonic frequencies and, in some embodiments, generating filter coefficients for shifting the phase in the input signal. The filter may be an all-pass filter.

In some embodiments, applying the filter to the input signal is performed in a cochlea module using one or more complex multipliers. Applying the filter to the input signal may involve changing the relative phases of spectral components in the input signal, thereby producing the filtered signal. Applying the filter to the input signal may be performed in a complex domain.

Also provided is a system for processing an audio signal to reduce loudspeaker distortion. In some embodiments, the system includes a pitch and salience estimator having a pitch tracker and target talker tracker. The pitch and salience estimator may be configured to determine a main frequency of an input signal. The system may also include a phase tracker configured to determine phases of harmonic frequencies relative to the main frequency. Furthermore, the system may include a target phase generator configured to generate poles and zeros based on the main frequency and to generate one or more filter coefficients for changing the phase of the harmonic frequencies.

In some embodiments, the phase generator is further configured to generate a filter configured to reduce voice coil excursion of the loudspeaker without using compression or any changes in a spectrum of the input signal. The system may be configured to apply the filter to the input signal to produce a filtered signal for providing to the loudspeaker. The filter may be an all-pass filter. In some embodiments, the system also includes a reconstructor.

In some embodiments, the system includes a cochlea module for initial processing of the input signal. The cochlea module may include a series of band-pass filters. A filter applicator module may be used for changing the phase of the harmonic frequencies with respect to the main frequency. The system may also include a memory for storing a linear model of the loudspeaker. In some embodiments, the system is a part of the loudspeaker.

DETAILED DESCRIPTION

Introduction

Figure 1:
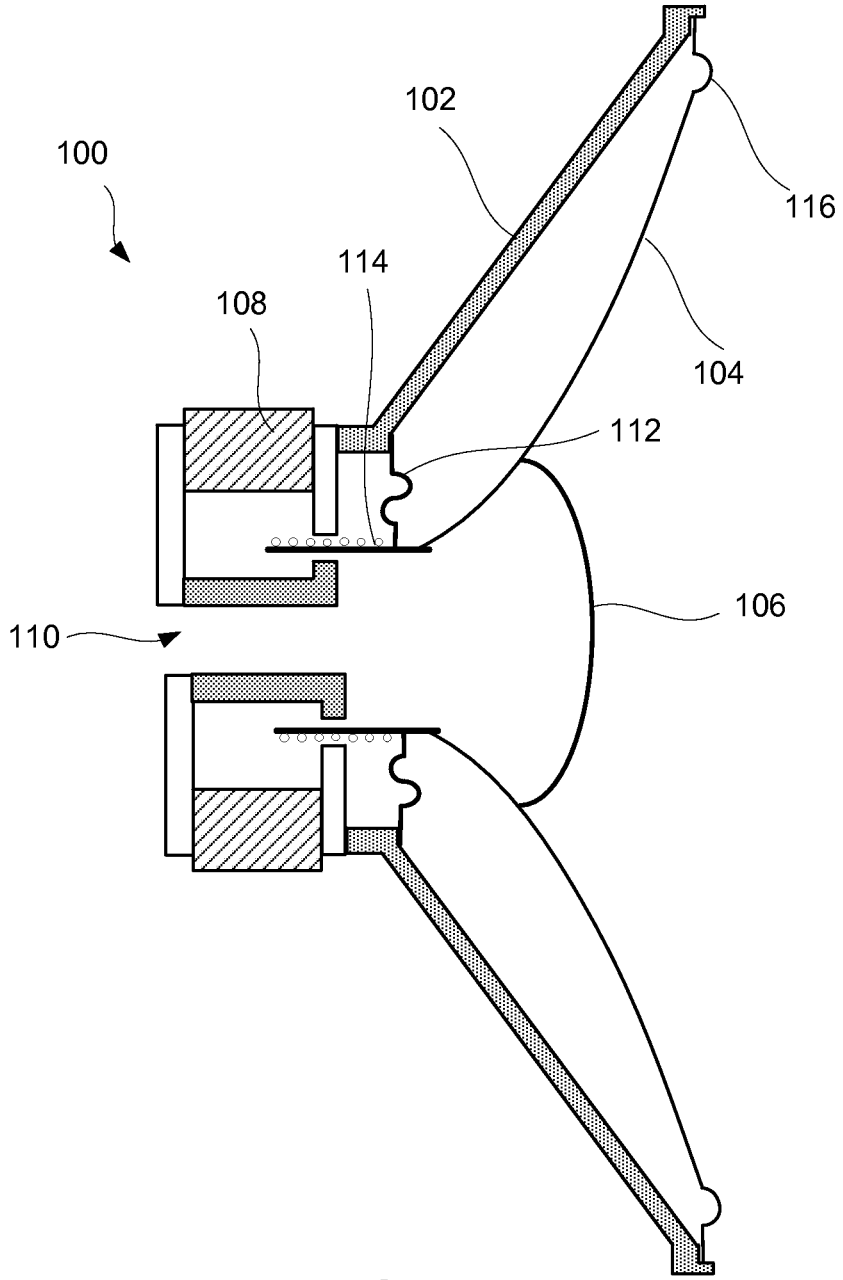
FIG. 1 illustrates a schematic representation of a loudspeaker, in accordance with some embodiments.

High quality sound reproduction by loudspeakers is increasingly problematic as the dimensions of loudspeaker decrease for many applications, such as mobile phone speakers, ear-buds, and other, similar devices. To produce enough power, large diaphragm excursions are needed, which give rise to significant distortions, especially at very low frequencies. Distortions tend to take a nonlinear form and are sometimes, referred to as loudspeaker nonlinearity. In most cases, the majority of nonlinear distortion is the result of changes in suspension compliance, motor force factor, and inductance or, more specifically, semi-inductance with voice coil position.

Because audio reproduction elements tend to decrease in size, there is also a search for smaller loudspeakers. This minimization of dimensions has physical limits, especially for low frequency radiators. To obtain a high quality response for low frequencies, excessive diaphragm excursions are needed, which generate high distortions. One approach to improve the transfer behavior of electro-acoustical transducers is to change the magnetic or mechanical design. Other solutions are based on traditional compression (especially of the low frequency components), signal limiting, servo feedback systems, other feedback and feed-forward systems, or using nonlinear pre-distortion of the signal. However, these types of changes lead to greater excursion that must be accommodated in the design of the transducer. Furthermore, some approaches cannot be applied to small size speakers, such as the ones used on mobile phones.

Methods and systems are provided that are specifically designed to reduce loudspeaker distortion by reducing voice coil excursion. Specifically, the voice coil excursion from its nominal rest condition is reduced without adversely affecting the desired output level of the loudspeaker at any frequency. An input audio signal is processed based on a specific linear model of a loudspeaker. This model is unique for each type of speaker and may be set for the entire lifetime of the speaker. In some embodiments, a model may be adjusted based on the temperature of certain components of the speaker and the wear of the speaker.

This approach may account for various characteristics of the speaker as described below. Specifically, in the typical loudspeaker, sound waves are produced by a diaphragm driven by an alternating current through a voice coil, which is positioned in a permanent magnetic field. Most nonlinearities of the transducer are due to the displacement (x) of the diaphragm. Three nonlinearities are typically found to be of major influence. The first nonlinearity is transduction between electric and mechanic domain, also known as the force factor (Bl(x)). The second nonlinearity is the stiffness of the spider suspension ($1/C_m(x)$). Finally, the third nonlinearity is the self-inductance of the voice coil (L(x)).

The dynamical behavior of the loudspeaker driven by an input voltage ($U_e$) may be represented by the following nonlinear differential equations:

$$U_e = R_e i + \frac{d(L_e(x)i)}{dt} + Bl(x)\dot{x} \quad \text{Equation 1}$$

$$Bl(x)i = m_t\ddot{x} + R_m\dot{x} + \frac{x}{C_m(x)} \quad \text{Equation 2}$$

Equation 1 describes the electrical port of the transducer with input current i and voice coil resistance Re. The mechanical part is given by Equation 2, which is a simple, damped ($R_m$) mass ($m_t$)–spring ($C_m(x)$) system driven by the force Bl(x)i. The displacement dependent parameters $L_e(x)$, Bl(x), and $C_m(x)$ are described by a Taylor series expansion, truncated after the second term:

$$L_e(x)=L_{eo}+l_{1X} \quad \text{Equation 3:}$$

$$Bl(x)=Bl_0+b_{1X} \quad \text{Equation 4:}$$

$$C_m(x)=C_{m0}+c_{1X} \quad \text{Equation 5:}$$

This series of equations allows modeling a second order harmonic and intermodulation distortion. The total nonlinear differential equation is obtained from substituting Equation 2 into Equation 1 using Equations 3-5. Linear and nonlinear parameters are determined by optimization on input impedance and sound pressure response measurements. Linear parameters are optimized using a least squares fit on input impedance measurements, while nonlinear model parameters ($l_1$, $b_1$, and $c_1$) are optimized using other methods.

A model is then used to generate a dynamic filter, which is subsequently applied to the audio signal. The filter changes the relative phases of the spectral components of the input signal to reduce estimated excursion peaks. In various embodiments, the filter does not apply any compression or make any changes to the spectrum of the input signal. The quality of the audio signal is not diminished as it is in traditional filter approaches. The processing of the input signal may involve determining a main frequency using a pitch and salience estimator module. The main frequency may then used to determine the fundamental frequency and multiples of the fundamental frequency provide the harmonics. The phases of all the harmonics (including the fundamental) may be measured and compared to a target vector of phases. The difference between the measured phases and the target phases may then used to calculate the poles and zeros, which in turn may be used to determine the corresponding filter coefficients. In some embodiments, the filter coefficients are complex multipliers and processing is performed by a cochlea module.

Phase manipulation may be performed to reduce a crest factor of a signal. Additionally, phase manipulation may minimize excursion of a loudspeaker. The present technology may be a Digital Signal Processing (DSP) solution that does not require any feedback. The method and systems can be easily integrated into existing audio processing systems and may require very little, if any, calibration time and no tuning time. As such, the techniques are highly scalable and applicable to all systems using loudspeakers and DSP.

LOUDSPEAKER EXAMPLES

A brief description of a loudspeaker is now presented to provide better understanding of methods and systems for processing an audio signal to reduce loudspeaker distortion. FIG. 1 illustrates a loudspeaker driver 100 (or simply a loudspeaker 100), in accordance with some embodiments. Loudspeaker 100 may include a frame 102, which may be made of metal or other sufficiently rigid material. Frame 102 is used for supporting a cone 104. Cone 104 may be made of paper or plastic and, occasionally, metal. The rear end of cone 104 is attached to a voice coil 114, which may include a coil of wire wound around an extension of cone 104 called a former. The two ends of voice coil 114 are connected to a crossover network, which in turn is connected to the speaker binding posts on the rear of the speaker enclosure. Voice coil 114 is suspended inside a permanent magnet 108 so that it lies in a narrow gap between the magnet pole pieces and the front plate. Voice coil 114 is kept centered by a spider 112 that is attached to frame 102 and voice coil 114. A rear vent 110 allows air to get into the back of driver 100 when cone 104 is moving. A dust cap 106 provided on cone 104 keeps air from getting in through the front. A flexible attachment 116 at the outer edge of cone 104 allows for flexible movement.

Some design variability may depend on the type of a loudspeaker. In the case of a tweeter, the cone is very light (e.g., made of silk). The cone may be glued directly to the voice coil. The cone may be unattached to a frame or rubber surround because it needs to be very low mass in order to respond quickly to high frequencies.

When an input signal passes through voice coil 114, voice coil 114 turns into an electromagnet, which causes it to move with respect to permanent magnet 108. As a result, cone 104 pushes or pulls the surrounding air creating sound waves.

The following description pertains to specific components of the speaker that may change the model used for processing an audio signal to reduce loudspeaker distortion. The cone is usually manufactured with a cone- or dome-shaped profile. A variety of different materials may be used, such as paper, plastic, and metal. The cone material should be rigid (to prevent uncontrolled cone motions), light (to minimize starting force requirements and energy storage issues), and well damped (to reduce vibrations continuing after the signal has stopped with little or no audible ringing due to its resonance frequency as determined by its usage). Since all three of these criteria cannot be fully met at the same time, the driver design involves trade-offs, which are reflected in the corresponding model used for processing an audio signal to reduce loudspeaker distortion. For example, paper is light and typically well damped, but is not stiff. On the other hand, metal may be stiff and light, but it usually has poor damping. Still further, plastic can be light, but stiffer plastics have poor damping characteristics. In some embodiments, some cones can be made of certain composite materials and/or have specific coatings to provide stiffening and/or damping.

The frame is generally rigid to avoid deformation that could change alignments with the magnet gap. The frame can be made from aluminum alloy or stamped from steel sheet. Some smaller speakers may have frames made from molded plastic and damped plastic compounds. Metallic frames can conduct heat away from the voice coil, which may impact the performance of the speaker and its linear model. Specifically, heating changes resistance, causing physical dimensional changes, and if extreme, may even demagnetize permanent magnets. The linear model may be adjusted to reflect these changes in the loudspeaker.

The spider keeps the coil centered in the gap and provides a restoring (centering) force that returns the cone to a neutral position after moving. The spider connects the diaphragm or voice coil to the frame and provides the majority of the restoring force. The spider may be made of a corrugated fabric disk impregnated with a stiffening resin.

The surround helps center the coil/cone assembly and allows free motion aligned with the magnetic gap. The surround can be made from rubber or polyester foam, or a ring of corrugated, resin coated fabric. The surround is attached to both the outer cone circumference and to the frame. These different surround materials and their shape and treatment can significantly affect the acoustic output of a driver. As such, these characteristics are reflected in a corresponding linear model used for processing an audio signal to reduce loudspeaker distortion. Polyester foam is lightweight and economical, but may be degraded by Ultraviolet (UV) light, humidity, and elevated temperatures.

The wire in a voice coil is usually made of copper, aluminum, and/or silver. Copper is the most common material. Aluminum is lightweight and thereby raises the resonant frequency of the voice coil and allows it to respond more easily to higher frequencies. However, aluminum is hard to process and maintain connection to. Voice-coil wire cross sections can be circular, rectangular, or hexagonal, giving varying amounts of wire volume coverage in the magnetic gap space. The coil is oriented co-axially inside the gap. It moves back and forth within a small circular volume (a hole, slot, or groove) in the magnetic structure. The gap establishes a concentrated magnetic field between the two poles of a permanent magnet. The outside of the gap is one pole, and the center post is the other. The pole piece and back plate are often a single piece, called the pole plate or yoke.

Magnets may be made of ceramic, ferrite, alnico, neodymium, and/or cobalt. The size and type of magnet and details of the magnetic circuit differ. For instance, the shape of the pole piece affects the magnetic interaction between the voice coil and the magnetic field. This shape is sometimes used to modify a driver's behavior. A shorting ring (i.e., a Faraday loop) may be included as a thin copper cap fitted over the pole tip or as a heavy ring situated within the magnet-pole cavity. This ring may reduce impedance at high frequencies, providing extended treble output, reduced harmonic distortion, and a reduction in the inductance modulation that typically accompanies large voice coil excursions. On the other hand, the copper cap may require a wider voice-coil gap with increased magnetic reluctance. This reduces available flux and requires a larger magnet for equivalent performance. All of these characteristics are reflected in the corresponding linear model for processing an audio signal to reduce loudspeaker distortion.

OVERALL SYSTEM EXAMPLES

Loudspeakers described herein may be used on various audio devices to improve the quality of audio produced by these devices. Some examples of audio devices include multi-microphone communication devices, such as mobile phones. One example of such a device will now be explained with reference to FIG. 2.

A multi-microphone system may have one primary microphone and one or more secondary microphones. For two or more secondary microphones, using the same adaptation constraints of a two-microphone system (in a cascading structure) may be sub-optimal, because it gives priority/preference to one of the secondary microphones.

Audio systems, in general, and communication systems, in particular, aim to improve audio quality provided by loudspeakers and in particular, processing an audio signal to reduce loudspeaker distortion. The input signals may be based on signals coming from multiple microphones included in a communication device. Alternatively, or simultaneously, an input signal may be based on a signal received through a communication network from a remote source. The resulting output signal may be supplied to an output device or a loudspeaker included in a communication device. Alternatively, or simultaneously, the output signal may be transmitted across a communications network.

Figure 2:
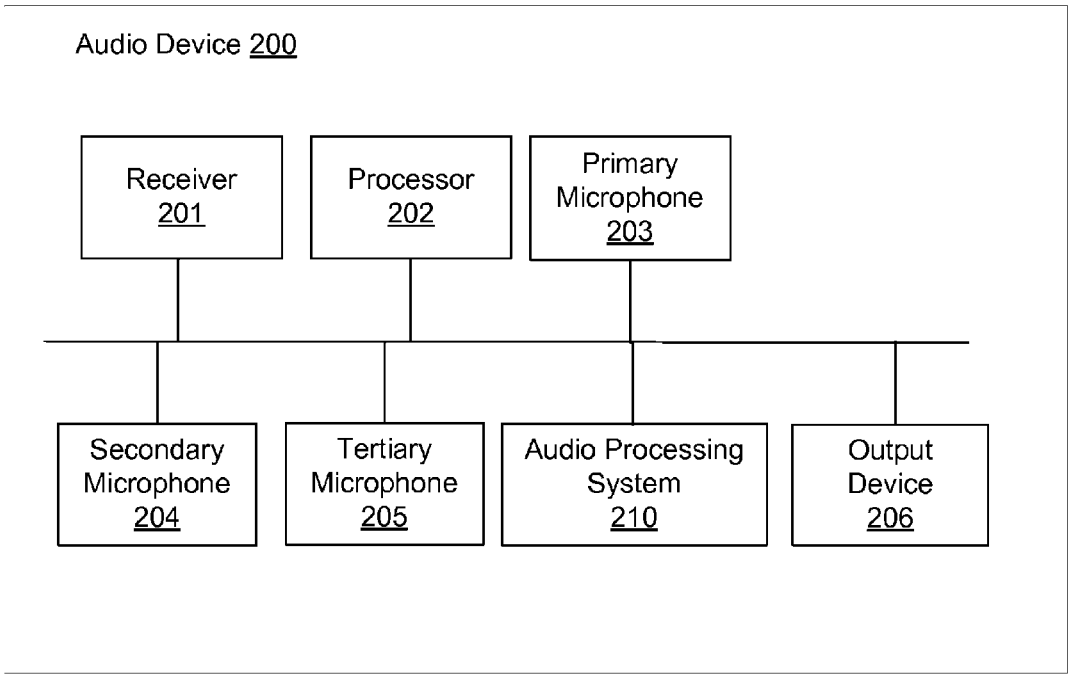
FIG. 2 illustrates a block diagram of an audio device, in accordance with some embodiments.

Referring to FIG. 2, audio device 200 is now shown in more detail. In some embodiments, the audio device 200 is an audio receiving device that includes a receiver 201, a processor 202, a primary microphone 203, a secondary microphone 204, a tertiary microphone 205, an audio processing system 210, and an output device 206. The audio device 200 may include more or other components necessary for its operation. Similarly, the audio device 200 may include fewer components that perform similar or equivalent functions to those depicted in FIG. 2.

Processor 202 may include hardware and software that implement the processing unit described above with reference to FIG. 2. The processing unit may process floating point operations and other operations for the processor 202. The receiver 201 may be an acoustic sensor configured to receive a signal from a (communication) network. In some embodiments, the receiver 201 may include an antenna device. The signal may then be forwarded to the audio processing system 210 and then to the output device 206. For example, audio processing system 210 may include various modules used to process the input signal in order to reduce loudspeaker distortion.

The audio processing system 210 may furthermore be configured to receive the input audio signals from an acoustic source via the primary microphone 203, the secondary microphone 204, and the tertiary microphone 205 (e.g., primary, secondary, and tertiary acoustic sensors) and process those acoustic signals. Alternatively, the audio processing system 210 receives the input signal from other audio devices or other components of the same audio device. For example, the audio input signal may be received from another phone over the communication network. Overall, processing an audio signal to reduce loudspeaker distortion may be implemented on all types of audio signal irrespective of their sources.

The secondary microphone 204 and the tertiary microphone 205 will also be collectively (and interchangeably) referred to as the secondary microphones. Similarly, the specification may refer to the secondary (acoustic or electrical) signals. The primary and secondary microphones 203-205 may be spaced a distance apart in order to allow for an energy level difference between them. After reception by the microphones 203-205, the acoustic signals may be converted into electric signals (i.e., a primary electric signal, a secondary electric signal, and a tertiary electrical signal). The electric signals may themselves be converted by an analog-to-digital converter (not shown) into digital signals for processing in accordance with some embodiments. In order to differentiate the acoustic signals, the acoustic signal received by the primary microphone 203 is herein referred to as the primary acoustic signal, while the acoustic signal received by the secondary microphone 204 is herein referred to as the secondary acoustic signal. The acoustic signal received by the tertiary microphone 205 is herein referred to as the tertiary acoustic signal. It should be noted that embodiments of the present invention may be practiced utilizing any plurality of secondary microphones. In some embodiments, the acoustic signals from the primary and both secondary microphones are used for improved noise cancellation as will be discussed further below. The primary acoustic signal, secondary acoustic signal, and tertiary acoustic signal may be processed by audio processing system 210 for further processing or sent to another device for producing a corresponding acoustic wave using a loudspeaker. It will be understood by one having ordinary skills in the art that two audio devices may be connected over a network (wired or wireless) into a system, in which one device is used to collect an audio signal and transmit to another device. The receiving device then processes an audio signal to reduce its loudspeaker distortion.

The output device 206 may be any device which provides an audio output to a listener (e.g., an acoustic source). For example, the output device 206 may include a loudspeaker, an earpiece of a headset, or a handset on the audio device 200. Various examples of loudspeakers are described above with reference to FIG. 1.

Some or all of processing modules described herein can include instructions that are stored on storage media. The instructions can be retrieved and executed by the processor 202. Some examples of instructions include software, program code, and firmware. Some examples of storage media comprise memory devices and integrated circuits. The instructions are operational when executed by the processor 202 to direct the processor 202 to operate in accordance with embodiments of the present invention. Those skilled in the art are familiar with instructions, processor(s), and (computer readable) storage media.

AUDIO PROCESSING SYSTEM EXAMPLES

Figure 3:
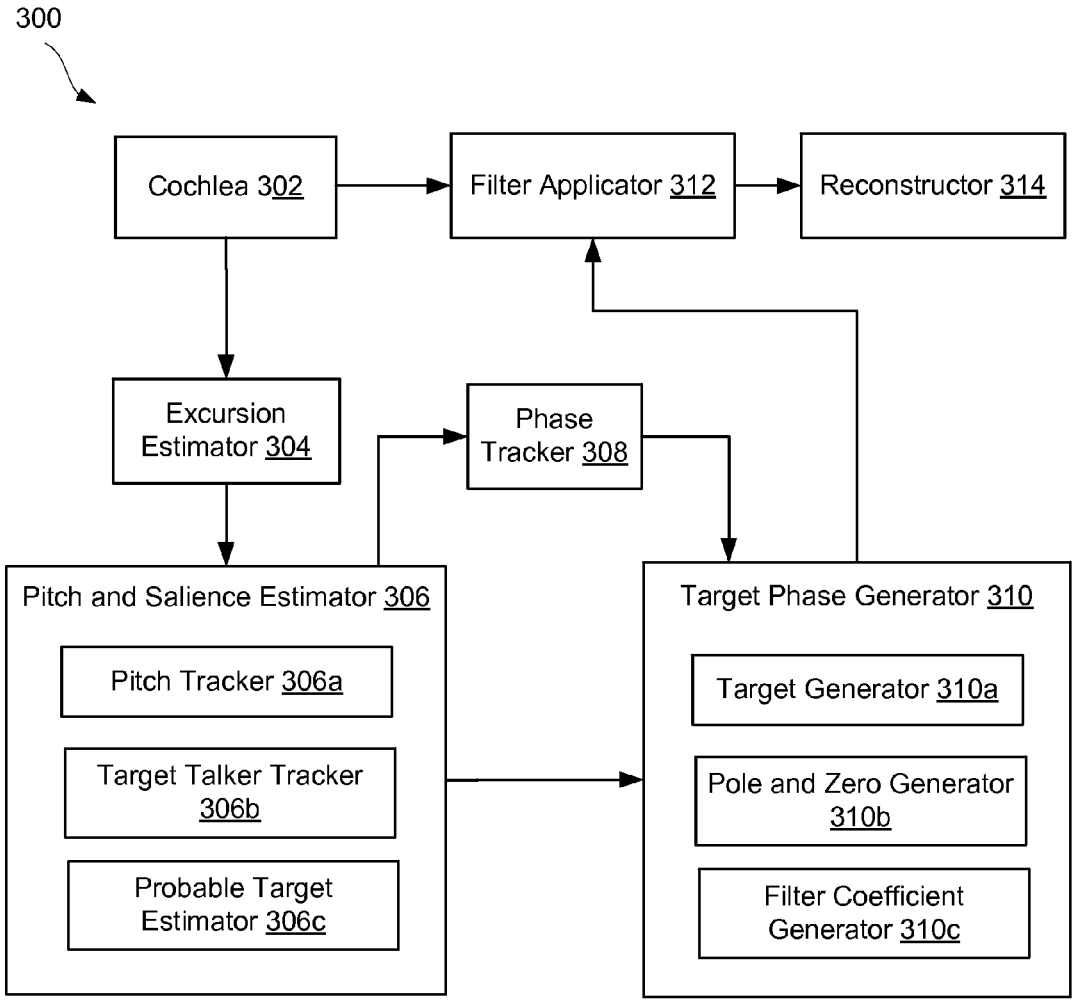
FIG. 3 illustrates a block diagram of an audio processing system, in accordance with certain embodiments.

FIG. 3 illustrates a block diagram of an audio processing system 300 for processing an audio signal to reduce loudspeaker distortion, in accordance with certain embodiments. Audio processing system 300 may include a cochlea module 302, excursion estimator 304, pitch and salience estimator 306, phase tracker 308, target phase generator 310, filter applicator 312, and reconstructor 314. Some or all of these modules may be implemented as software stored on a computer readable media described elsewhere in this document.

The input audio signal may be first passed through cochlea module 302. Overall, paths of various signals within audio processing system 300 are illustrated with arrows. One having ordinary skills in the art would understand that these arrows may not represent all paths, and some paths may be different. Some variations are further described below with reference to FIG. 4 corresponding to a method for processing an audio signal to reduce loudspeaker distortion. Cochlea module 302 may include a series of band-pass filters used to generate a processed signal from the input signal. Specific examples and details of cochlear modules are described in U.S. patent application Ser. No. 13/397,597, entitled "System and Method for Processing an Audio Signal", filed Feb. 15, 2012, which is incorporated herein by reference in its entirety for purposes of describing cochlear models.

Pitch and salience estimator 306 may include a number of sub-modules, such as a pitch tracker 306*a*, target talker tracker 306*b*, and probable target estimator 306*c*. Pitch and salience estimator 306 may be configured to determine a main frequency of the input signal. Phase tracker 308 may be configured to determine phases of harmonic frequencies relative to the main frequency. Target phase generator 310 may be configured to measure and compare the phases of all the harmonics (including the fundamental) to a target vector of phases. Target phase generator 310 may also be configured to use the difference between the measured phases and the target phases to calculate poles and zeroes, which in turn may be used to determine the corresponding filter coefficients. Target phase generator 310 may include a number of sub-modules, such as target generator 310*a*, pole and zero generator 310*b*, and filter coefficient generator 310*c*.

PROCESSING EXAMPLES

Figure 4:
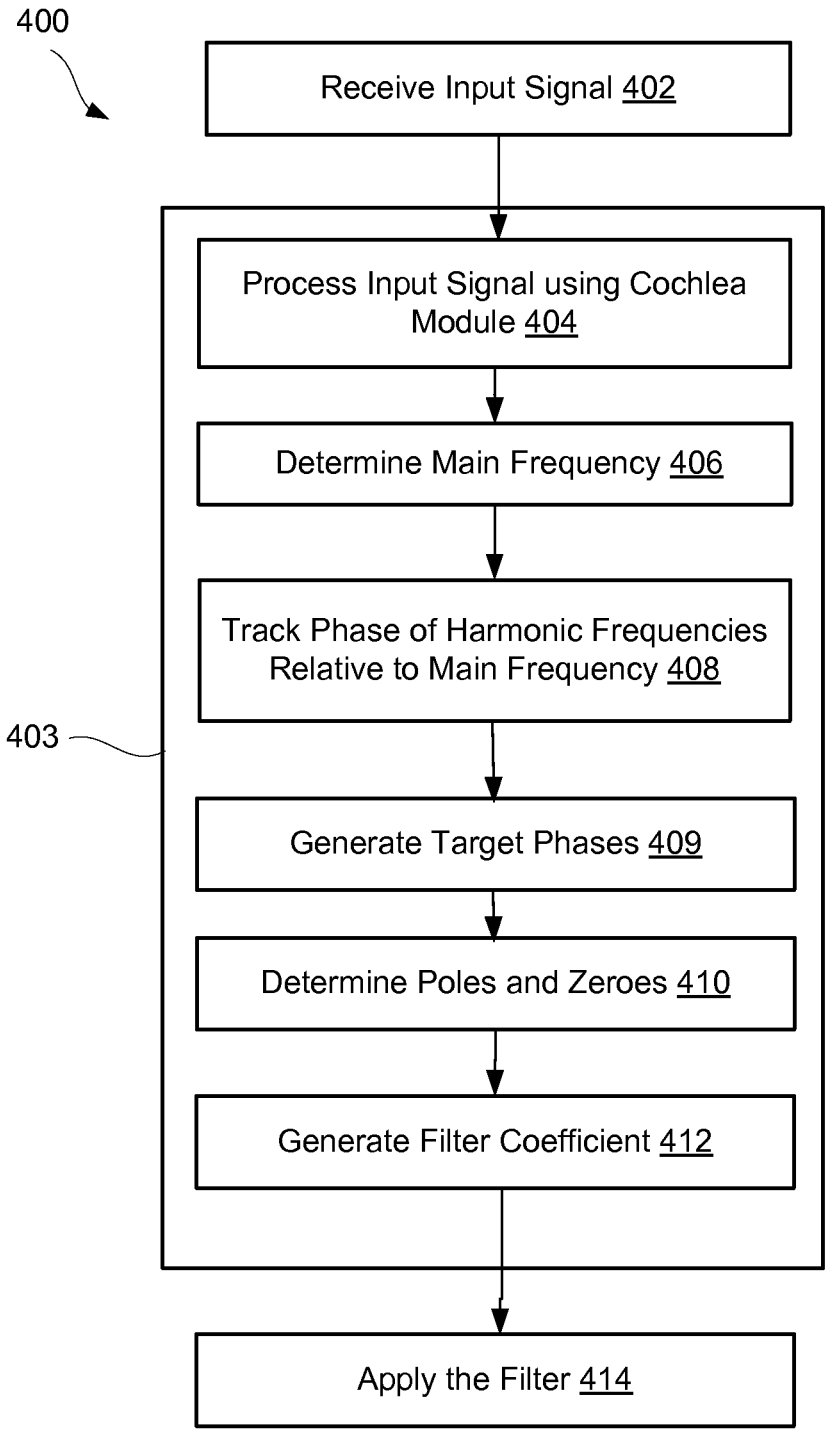
FIG. 4 illustrates a process flowchart corresponding to a method for processing an audio signal to reduce loudspeaker distortion, in accordance with certain embodiments.

FIG. 4 illustrates a process flowchart corresponding to a method 400 for processing an audio signal to reduce loudspeaker distortion. Method 400 may commence with receiving an input signal during operation 402. This input signal is normally used to drive the loudspeaker. In the presented process, it is also used to generate a filter and pass this input signal through this dynamically generated filter. Method 400 may proceed with analyzing the input signal based on a linear model of a loudspeaker and dynamically producing a filter for applying to the input signal during a series of operations collectively identified as block 403. As stated above and for various embodiments, the generated filter is configured to reduce voice coil excursion of the loudspeaker without using compression or any changes in a spectrum of the input signal.

Analyzing the input signal may involve processing the input signal using a cochlea module during operation 404. Analyzing the input signal may also involve estimating pitch and salience of the input signal and, in some embodiments, determining a main frequency of the input signal and tracking phases of harmonic frequencies relative to the main frequency during operation 406. Method 400 may also involve a tracking phase of harmonic frequencies relative to the main frequency during operation 408, generating target phases 409, and determining poles and zeroes of the harmonic frequencies during operation 410. These poles and zeroes may be used to generate filter coefficients during operation 412. The filter coefficients are used for changing the phases of the harmonic frequencies in the input signal. The filter may be an all-pass filter.

In some embodiments, applying the filter to the input signal during operation 414 is performed in a cochlea module using one or more complex multipliers. Applying the filter to the input signal may involve changing relative phases of spectral components in the input signal, thereby producing the filtered signal. In this case, applying the filter to the input signal may be performed in a complex domain.

CONCLUSION

The present technology is described above with reference to exemplary embodiments. It will be apparent to those skilled in the art that various modifications may be made and that other embodiments can be used without departing from the broader scope of the present technology. Therefore, these and other variations upon the exemplary embodiments are intended to be covered by the present technology.

The invention claimed is:

1. A method for processing an audio signal to reduce loudspeaker distortion, the method comprising:

receiving an input signal;

analyzing the input signal based on a linear model specific to a type of loudspeaker;

based on the analysis from the linear model, dynamically producing a filter for applying to the input signal, wherein the filter is configured to reduce loudspeaker distortion by reducing voice coil excursion of the loudspeaker; and applying the filter to the input signal to produce a filtered signal for providing to the loudspeaker.

2. The method of claim 1, wherein applying the filter to the input signal comprises changing relative phases of spectral components in the input signal, thereby producing the filtered signal.

3. The method of claim 1, wherein the filter is configured to reduce the voice coil excursion of the loudspeaker without using compression.

4. The method of claim 1, wherein the filter is configured to reduce the voice coil excursion of the loudspeaker without any changes in the spectrum of the input signal.

5. The method of claim 2, wherein the filter is configured to reduce the voice coil excursion of the loudspeaker without using compression or any changes in the spectrum of the input signal.

6. The method of claim 1, wherein analyzing the input signal comprises processing the input signal using a cochlea module, the cochlea module comprising a series of band-pass filters.

7. The method of claim 1, wherein analyzing the input signal comprises estimating pitch and salience of the input signal.

8. The method of claim 1, wherein analyzing the input signal comprises determining a main frequency of the input signal and tracking phases of harmonic frequencies relative to the main frequency.

9. The method of claim 8, further comprising determining poles and zeroes of the harmonic frequencies.

10. The method of claim 9, wherein dynamically producing the filter comprises generating filter coefficients for shifting the harmonic frequencies in the input signal.

11. The method of claim 10, wherein the filter is an all-pass filter.

12. The method of claim 1, wherein applying the filter to the input signal is performed using one or more complex multipliers.

13. The method of claim 1, wherein applying the filter to the input signal is performed in a complex domain.

14. A system for processing an audio signal to reduce loudspeaker distortion, the system comprising:

a pitch and salience estimator, the pitch and salience estimator being configured to determine a main frequency of an input signal;

a phase tracker configured to determine phases of harmonic frequencies relative to the main frequency; and a target phase generator configured to generate poles and zeros based on the main frequency and to dynamically generate one or more filter coefficients for changing the harmonic frequencies with respect to the main frequency.

15. The system of claim 14, wherein the target phase generator is further configured to generate a filter configured to reduce loudspeaker distortion by reducing voice coil excursion of the loudspeaker without using compression or any changes in a spectrum of the input signal.

16. The system of claim 15, wherein the system is configured to apply the filter to the input signal to produce a filtered signal for providing to the loudspeaker.

17. The system of claim 15, wherein the filter is an all-pass filter.

18. The system of claim 14, further comprising a reconstructor.

19. The system of claim 14, further comprising a cochlea module for initial processing of the input signal, the cochlea module comprising a series of band-pass filters.

20. The system of claim 19, wherein the cochlea module is used for changing the harmonic frequencies with respect to the main frequency.

21. The system of claim 14, further comprising a memory for storing a linear model of the loudspeaker, the linear model being specific to a type of the loudspeaker.

22. The system of claim 14, wherein the system is a part of the loudspeaker.

23. A method for processing an audio signal to reduce loudspeaker distortion, the method comprising:

receiving an input signal;

analyzing the input signal using a cochlea module comprising a series of band-pass filters, the analyzing performed based on a linear model specific to a type of loudspeaker and comprising estimating pitch and salience of the input signal, determining a main frequency of the input signal and tracking phases of harmonic frequencies relative to the main frequency, and determining poles and zeroes of the harmonic frequencies;

based on the analysis, dynamically producing a filter for applying to the input signal by generating filter coefficients for shifting the harmonic frequencies in the input signal; and applying the filter to the input signal to produce a filtered signal for providing to the loudspeaker.

* * * * *